US010741113B2

(12) United States Patent
Lee

(10) Patent No.: US 10,741,113 B2
(45) Date of Patent: Aug. 11, 2020

(54) DISPLAY DEVICE AND METHOD OF DRIVING THE SAME

(71) Applicant: Samsung Display Co. Ltd., Yongin-Si (KR)

(72) Inventor: Chang-soo Lee, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 14 days.

(21) Appl. No.: 16/052,622

(22) Filed: Aug. 2, 2018

(65) Prior Publication Data

US 2019/0108778 A1 Apr. 11, 2019

(30) Foreign Application Priority Data

Oct. 11, 2017 (KR) ..... 10-2017-0131656

(51) Int. Cl.
*G09G 3/00* (2006.01)

(52) U.S. Cl.
CPC ..... *G09G 3/006* (2013.01); *G09G 2310/08* (2013.01); *G09G 2330/12* (2013.01)

(58) Field of Classification Search
None
See application file for complete search history.

(56) References Cited

U.S. PATENT DOCUMENTS

| | | | | |
|---|---|---|---|---|
| 7,466,312 | B2 | 12/2008 | Choi et al. | |
| 2017/0039974 | A1 | 2/2017 | Kang et al. | |
| 2018/0012533 | A1* | 1/2018 | Lee | G09G 3/2092 |

FOREIGN PATENT DOCUMENTS

| | | |
|---|---|---|
| JP | 5762330 | 8/2015 |
| KR | 10-0555528 | 3/2006 |
| KR | 10-2014-0137501 | 12/2014 |
| KR | 10-2017-0017054 | 2/2017 |

* cited by examiner

*Primary Examiner* — Kenneth B Lee, Jr.
(74) *Attorney, Agent, or Firm* — H.C. Park & Associates, PLC

(57) ABSTRACT

A display device includes a display panel including a plurality of pixels, a gate driving circuit outputting a plurality of gate signals to the pixels, and a detection circuit receiving a first gate signal and a second gate signal among the gate signals, comparing a first voltage difference between a first high voltage of the first gate signal and a reference voltage with a second voltage difference between a second high voltage of the second gate signal and the reference voltage to obtained a compared result, and determining whether the first and second gate signals are normal signals based on the compared result.

20 Claims, 14 Drawing Sheets

FIG. 6C

| First Voltage Difference | Second Voltage Difference | Third Voltage Difference | Fourth Voltage Difference | |
|---|---|---|---|---|
| VLt | VLt | VLt | VLt | → DS_T |
| VLf | VLt | VLt | VLt | → DS_F |
| VLt | VLt | VLf | VLt | → DS_F |

FIG. 7C

| First Voltage Difference | Second Voltage Difference | Third Voltage Difference | |
|---|---|---|---|
| VLt | VLt | VLt | → DS_T |
| VLt | VLf | VLt | → DS_F |
| VLf | VLt | VLt | → DS_F |

DISPLAY DEVICE AND METHOD OF DRIVING THE SAME

CROSS-REFERENCE TO RELATED APPLICATION

This application claims priority from and the benefit of Korean Patent Application No. 10-2017-0131656, filed on Oct. 11, 2017, which is hereby incorporated by reference for all purposes as if fully set forth herein.

BACKGROUND

Field

Exemplary embodiments/implementations of the invention relate generally to a display device. More particularly, the present disclosure relates to a display device and a method of driving the display device.

Discussion of the Background

As information technology develops, the market for display devices that serve as a connection between a user and information continues to increase. Accordingly, various display devices, e.g., an organic light emitting display device, a liquid crystal display device, a plasma display panel, etc., are widely used.

Some of the above-mentioned display devices, for example, the liquid crystal display device or the organic light emitting display device, include a display panel including pixels arranged in a matrix form and a driver driving the display panel. The driver includes a gate driving circuit that applies a scan signal (or a gate signal) to the display panel and a data driving circuit that applies a data signal to the display panel. When the gate signal and the data signal are applied to the pixels arranged in the matrix form, selected pixels emit lights, and thus the display device displays an image.

The above information disclosed in this Background section is only for understanding of the background of the inventive concepts, and, therefore, it may contain information that does not constitute prior art.

SUMMARY

Exemplary embodiments of the invention provide a display device capable of detecting a distorted gate signals to detect defects.

Exemplary embodiments provide a method of driving the display device to detect defects based on detecting distorted gate signals.

An exemplary embodiment discloses a display device including a display panel including a plurality of pixels, a gate driving circuit outputting a plurality of gate signals to the pixels, and a detection circuit receiving a first gate signal and a second gate signal among the gate signals, comparing a first voltage difference between a first high voltage of the first gate signal and a reference voltage with a second voltage difference between a second high voltage of the second gate signal and the reference voltage, and determining whether the first and second gate signals are normal signals based on the compared result.

The first high voltage may be a voltage level after a predetermined time elapses from a time point at which an active period of the first gate signal starts, and the second high voltage may be a voltage level after a predetermined time elapses from a time point at which an active period of the second gate signal starts.

The first high voltage may have a maximum voltage level of the first gate signal, and the second high voltage may have a maximum voltage level of the second gate signal.

The detection circuit may include a comparator unit outputting a first comparison signal corresponding to the first voltage difference and a second comparison signal corresponding to the second voltage difference and a determiner receiving the first comparison signal and the second comparison signal to determine whether the first and second gate signals are the normal signals.

The comparator unit may include a first comparator outputting the first comparison signal and a second comparator outputting the second comparison signal.

The detection circuit may further include a reference voltage generator that outputs the reference voltage, and the reference voltage generator outputs the reference voltage each of the first comparator and the second comparator.

The detection circuit may include a first detection unit and a second detection unit, the first detection unit receiving the first gate signal and the second gate signal to determine whether the first and second gate signals are the normal signals, and the second detection unit receiving a third gate signal and a fourth gate signal among the gate signals to determine whether the third and fourth gate signals are the normal signals.

The second detection unit may compare a third voltage difference between a third high voltage of the third gate signal and the reference voltage with a fourth voltage difference between a fourth high voltage of the fourth gate signal and the reference voltage to determine whether the third and fourth gate signals are the normal signals based on the compared result.

The detection circuit may determine that the first gate signal and the second gate signal are the normal signals when the first voltage difference is equal to the second voltage difference.

The detection circuit may determine that one gate signal of the first gate signal and the second gate signal is a distortion signal when the first voltage difference is different from the second voltage difference.

The detection circuit may compare the reference voltage with each of high voltage of the gate signals and determine whether the gate signals are the normal signals based on voltage differences according to the compared result.

The detection circuit may be built into the gate driving circuit.

An exemplary embodiment also discloses a display device including a gate driving circuit sequentially outputting a plurality of gate signals, a display panel comprising a plurality of pixels driven in response to active periods of the gate signals, and a detection circuit receiving first, second, and third gate signals among the gate signals, comparing a first voltage difference between the first gate signal and the second gate signal with a second voltage difference between the second gate signal and the third gate signal, and determining whether the first, second, and third gate signals are normal signals based on the compared result.

The active periods may include the same period, and the gate driving circuit may sequentially output the gate signals such that the active periods of at least two gate signals adjacent to each other among the gate signals overlap with each other.

The first voltage difference may be a difference between a maximum voltage level of the first gate signal and a maximum voltage level of the second gate signal in a period in which the active periods of the first and second gate signals overlap with each other, and the second voltage difference may be a difference between the maximum voltage level of the second gate signal and a maximum voltage level of the third gate signal in a period in which the active periods of the second and third gate signals overlap with each other.

The gate driving circuit may sequentially output the gate signals at a predetermined time interval shorter than the active period.

The first voltage difference may be a difference between a voltage level of the first gate signal after a predetermined time elapses from a time point at which the first gate signal is transited to a high voltage from a low voltage and a voltage level of the second gate signal after a predetermined time elapses from a time point at which the second gate signal is transited to the high voltage from the low voltage.

The detection circuit may include a first comparator outputting a first comparison signal of the first voltage difference, a second comparator outputting a second comparison signal of the second voltage difference, and a determiner receiving the first comparison signal and the second comparison signal to determine whether the first, second, and third gate signals are the normal signals based on the compared result.

The first comparator may receive the first gate signal and the second gate signal, and the second comparator may receive the second gate signal and the third gate signal.

An exemplary embodiment may also disclose a method of driving a display device including receiving a first gate signal applied to pixels arranged in a first row, receiving a second gate signal applied to pixels arranged in a second row, comparing a first voltage difference between a first high voltage of the first gate signal and a reference voltage with a second voltage difference between a second high voltage of the second gate signal and the reference voltage, and determining whether the first and second gate signals are normal signals based on the compared result.

According to the above exemplary embodiments of the invention, the display device may include the detection circuit that detects the distortion signal of the gate signals. Accordingly, a driving reliability of the display device may be improved.

Additional features of the inventive concepts will be set forth in the description which follows, and in part will be apparent from the description, or may be learned by practice of the inventive concepts.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

FIG. 6C is a table showing information about distortion of a gate signal based on an operation of the detection circuit shown in FIG. 6A.

FIG. 7C is a table showing information about distortion of a gate signal based on an operation of the detection circuit shown in FIG. 7A.

DETAILED DESCRIPTION

Figure 1:
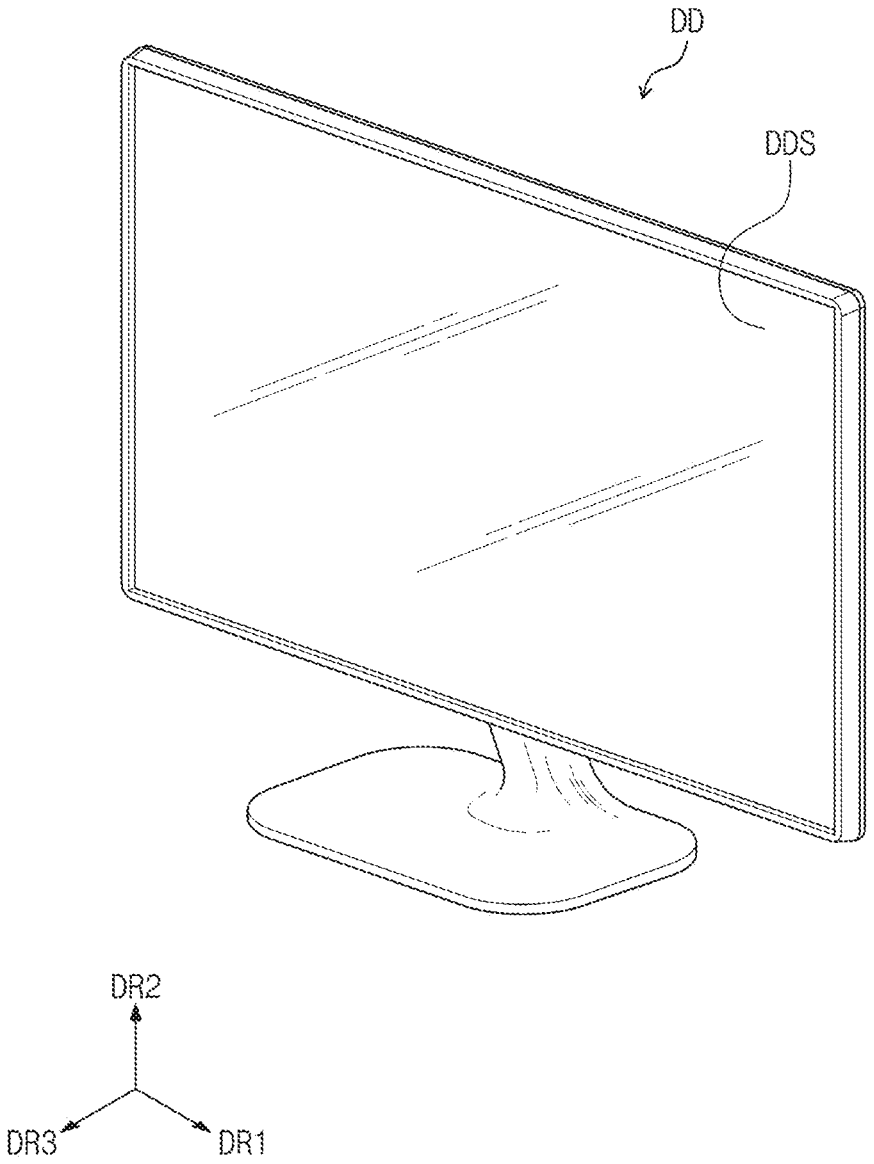
FIG. 1 is a perspective view showing a display device according to an exemplary embodiment of the invention.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

When an element, such as a layer, is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z-axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular exemplary embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 2:
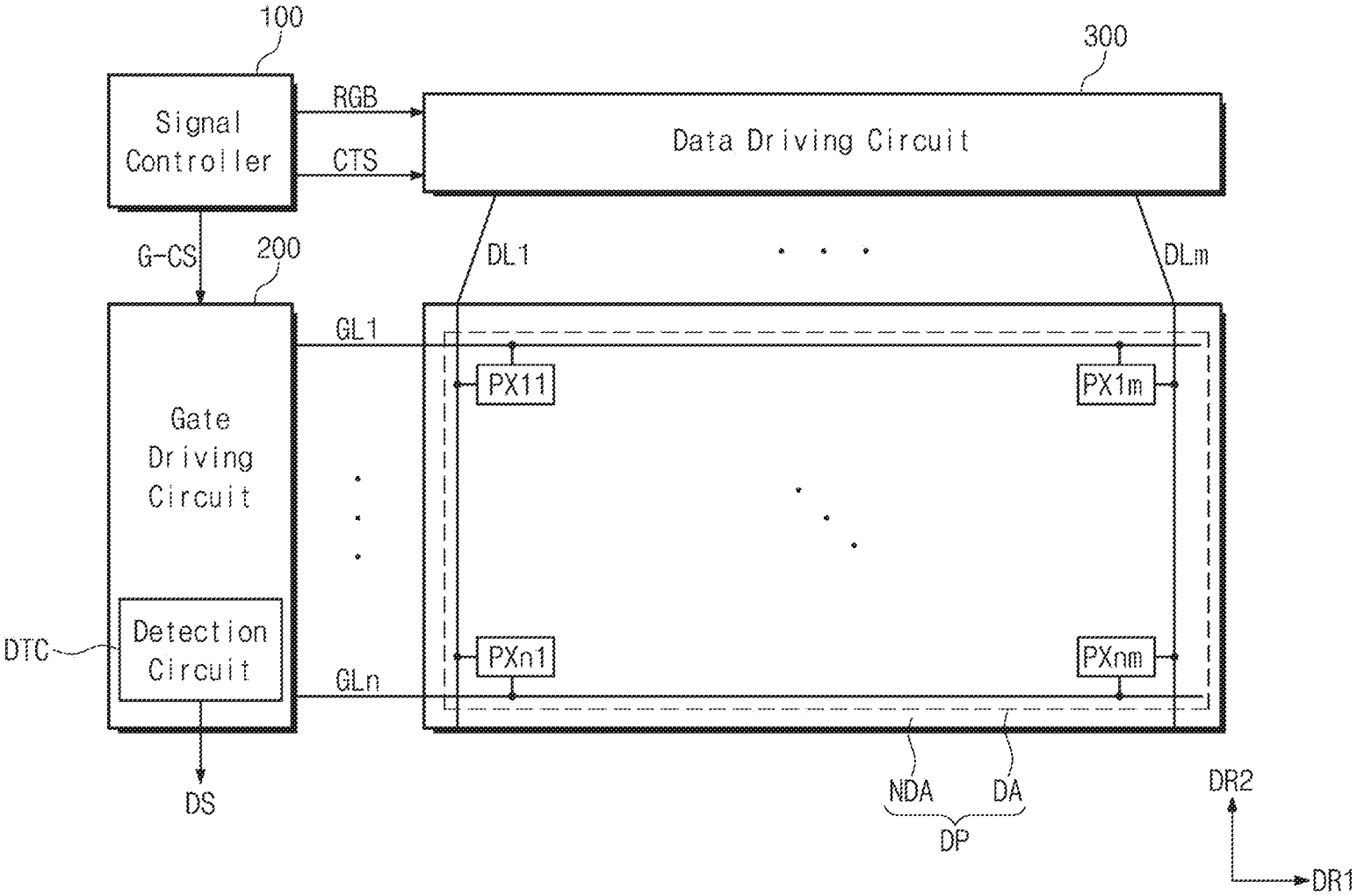
FIGS. 2 and 3 are block diagrams showing a display device according to an exemplary embodiment.
Figure 3:
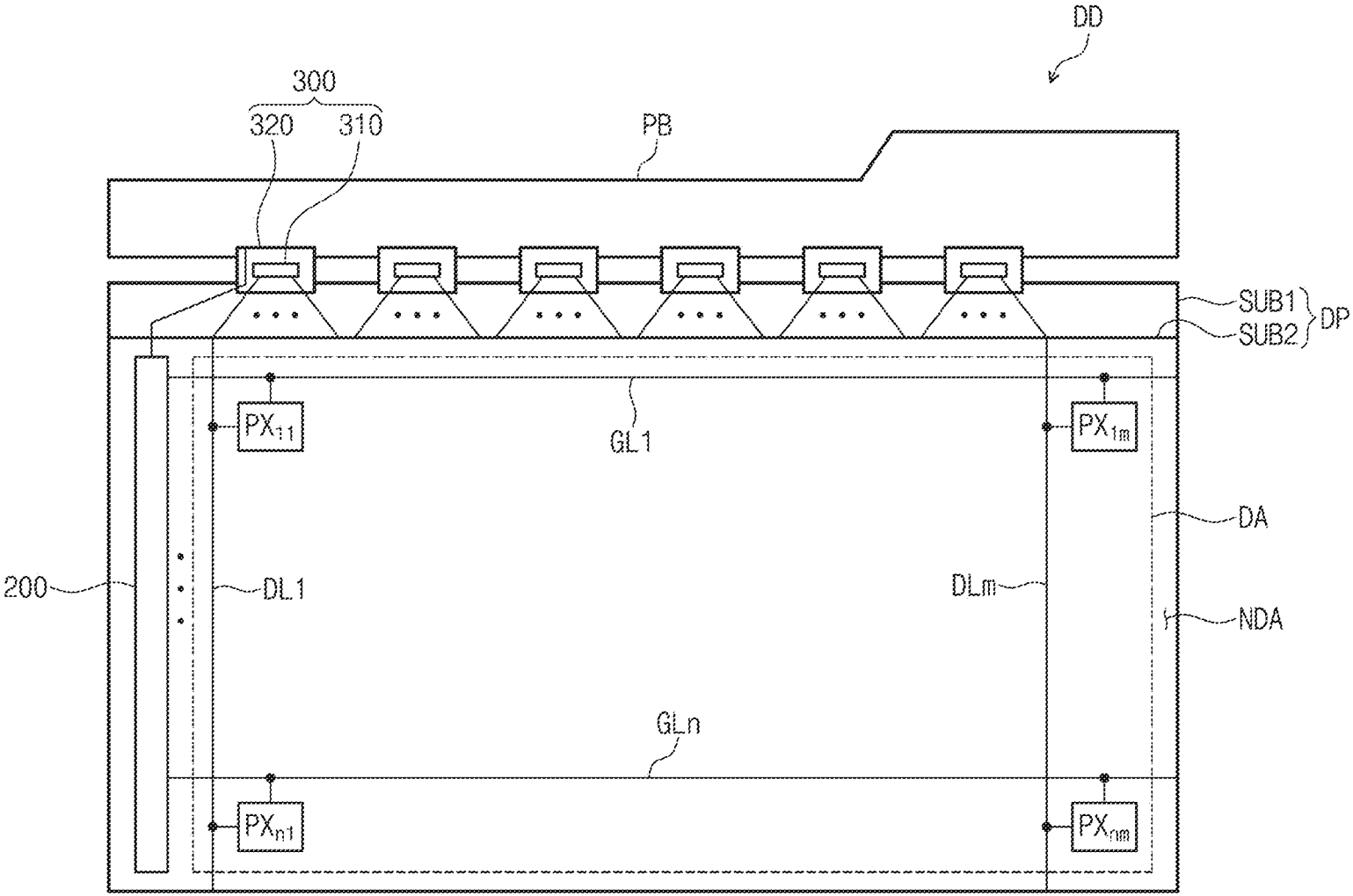

FIG. 1 is a perspective view showing a display device DD according to an exemplary embodiment. FIGS. 2 and 3 are block diagrams showing the display device DD according to an exemplary embodiment.

FIG. 1 shows a monitor as a representative example of the display device DD. In the present exemplary embodiment, the monitor having a flat display surface DDS will be described as the display device DD, but the display device DD should not be limited to the monitor having the flat display surface DDS. The display device DD may have a curved display surface. The display device DD according to the present disclosure may be applied to a medium and large-sized electronic item, such as a notebook computer, a television set, etc., and a small-sized electronic item, such as a mobile phone, a tablet, a game unit, a smart watch, etc.

The display device DD includes the display surface DDS defined by a first direction DR1 and a second direction DR2. A third direction DR3 indicates a normal line direction of the display surface DDS, i.e., a thickness direction of the display device DD. Front (or upper) and rear (or lower) surfaces of each member of the display device DD are distinguished from each other by the third direction DR3. However, directions indicated by the first, second, and third directions DR1, DR2, and DR3 are relative to each other, and thus the directions indicated by the first, second, and third directions DR1, DR2, and DR3 may be changed to other directions. Hereinafter, the first, second, and third directions are respectively indicated by the first, second, and third directions DR1, DR2, and DR3 and assigned with the same reference numerals.

Referring to FIG. 2, the display device DD includes a display panel DP, a signal controller 100, a gate driving circuit 200, and a data driving circuit 300.

According to an exemplary embodiment, the display panel DP may be, but not limited to, a liquid crystal display panel, an organic light emitting diode panel, a plasma display panel, an electrophoretic display panel, a microelectromechanical system display panel, and an electrowetting display panel.

The display panel DP includes a plurality of gate lines GL1 to GLn, a plurality of data lines DL1 to DLm, and a plurality of pixels PX11 to PXnm. The display panel DP includes a display area DA in which the pixels PX11 to PXnm are arranged and a non-display area NDA surrounding the display area DA.

The gate lines GL1 to GLn extend in the first direction DR1 and are arranged in the second direction DR2. The data lines DL1 to DLm are insulated from the gate lines GL1 to GLn while crossing the gate lines GL1 to GLn. The gate lines GL1 to GLn are connected to the gate driving circuit 200, and the data lines DL1 to DLm are connected to the data driving circuit 300.

The pixels PX11 to PXnm are arranged in a matrix form. Each of the pixels PX11 to PXnm is connected to a corresponding gate line of the gate lines GL1 to GLn and a corresponding data line of the data lines DL1 to DLm.

Although not shown in figures, the signal controller 100 receives a plurality of image signals and a plurality of control signals from an external source. The signal controller 100 converts the image signals from the external source to image signals RGB suitable for an operation mode of the display panel DP and applies the image signals RGB to the data driving circuit 300. Here, the image signals RGB may be, but not limited to, digital signals.

In addition, the signal controller 100 receives the controls signals, e.g., a vertical synchronization signal, a horizontal synchronization signal, a main clock signal, a data enable signal, etc., and outputs a gate control signal G-CS and a control signal CTS. The signal controller 100 applies the gate control signal G-CS to the gate driving circuit 200 and applies the control signal CTS to the data driving circuit 300.

The gate driving circuit 200 outputs gate signals to the gate lines GL1 to GLn in response to the gate control signal G-CS. For instance, the gate control signal G-CS includes a vertical start signal that starts an operation of the gate driving circuit 200, a gate clock signal that determines an output timing of a gate voltage, and an output enable signal that determines an on-pulse width of the gate voltage.

According to the exemplary embodiment, the gate driving circuit 200 includes a detection circuit DTC. The detection circuit DTC may determine whether the gate signals applied to the pixels PX11 to PXnm are normal. That is, the detection circuit DTC may check whether a signal distortion occurs in the gate signals output from the gate driving circuit 200.

For instance, the detection circuit DTC may be operated in an initial operation mode of the display device DD. The detection circuit DTC applies a determination signal DS obtained by determining whether the gate signals are normal to the signal controller 100. The operation of the detection circuit DTC will be described in detail with reference to FIG. 4.

The data driving circuit 300 receives the control signal CTS and the image signals RGB. The data driving circuit 300 converts the image signals RGB to a plurality of data voltages in response to the control signal CTS and applies the data voltages to the data lines DL1 to DLm. For instance, the control signal CTS includes a horizontal start signal that starts an operation of the data driving circuit 300, an inversion signal that inverts a polarity of the data voltages, and an output indicating signal that determines an output timing of the data voltages.

Referring to FIG. 3, the display device DD includes a circuit board PB, the gate driving circuit 200, the data driving circuit 300, and the display panel DP. The display panel DP includes a first substrate SUB1 and a second substrate SUB2.

The gate lines GL1 to GLn and the data lines DL1 to DLm crossing the gate lines GL1 to GLn are disposed on the second substrate SUB2. Each of the pixels PX11 to PXnm is connected to the corresponding gate line of the gate lines GL1 to GLn and the corresponding data line of the data lines DL1 to DLm.

The gate driving circuit 200 may be substantially simultaneously formed with the pixels PX11 to PXnm through a thin film process. For instance, the gate driving circuit 200 may be mounted on the non-display area NDA in an amorphous silicon TFT gate driver circuit (ASG) form, but it should not be limited thereto or thereby. That is, the gate driving circuit 200 may be connected to the display panel DP in a tape carrier package (TCP) form. In this case, the gate driving circuit 200 may be electrically connected to the display panel DP through a plurality of flexible printed circuit boards.

In addition, the gate driving circuit 200 is connected to left ends of the gate lines GL1 to GLn, but it should not be limited thereto or thereby. That is, the display device may include two gate driving circuits. One gate driving circuit of the two gate driving circuits may be connected to left ends of the gate lines GL1 to GLn, and the other gate driving circuit of the two gate driving circuits (not shown) may be connected to right ends of the gate lines GL1 to GLn. Further, one gate driving circuit of the two gate driving circuits may be connected to odd-numbered gate lines, and the other gate driving circuit of the two gate driving circuits may be connected to even-numbered gate lines.

The data driving circuit 300 receives the control signal CTS and the image signals RGB from the signal controller 100 (refer to FIG. 2) mounted on the circuit board PB and generates analog data voltages corresponding to the image signals RGB.

The data driving circuit 300 includes a driving chip 310 and a flexible printed circuit board 320 on which the driving chip 310 is mounted. Each of the driving chip 310 and the flexible printed circuit board 320 may be provided in a plural number. The flexible printed circuit board 320 electrically connects the circuit board PB to the first substrate SUB1. The driving chips 310 apply the data voltages to corresponding data lines, respectively.

Figure 4:
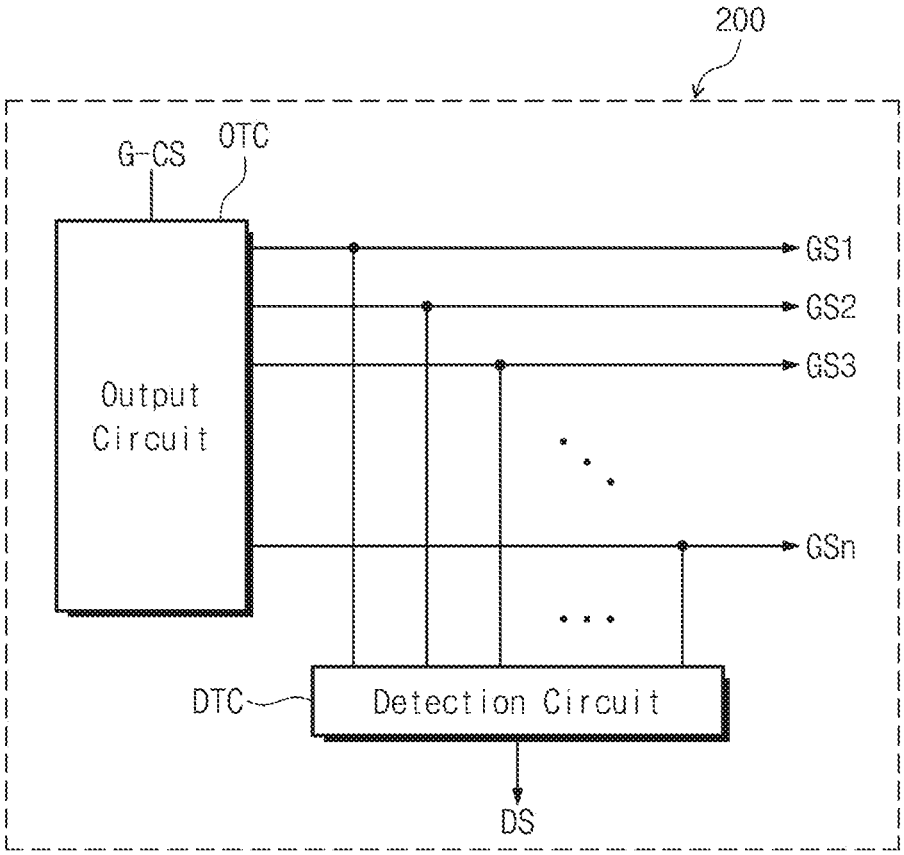
FIG. 4 is a block diagram showing an output circuit and a detection circuit, which are included in a gate driver circuit shown in FIG. 2.
Figure 5A:
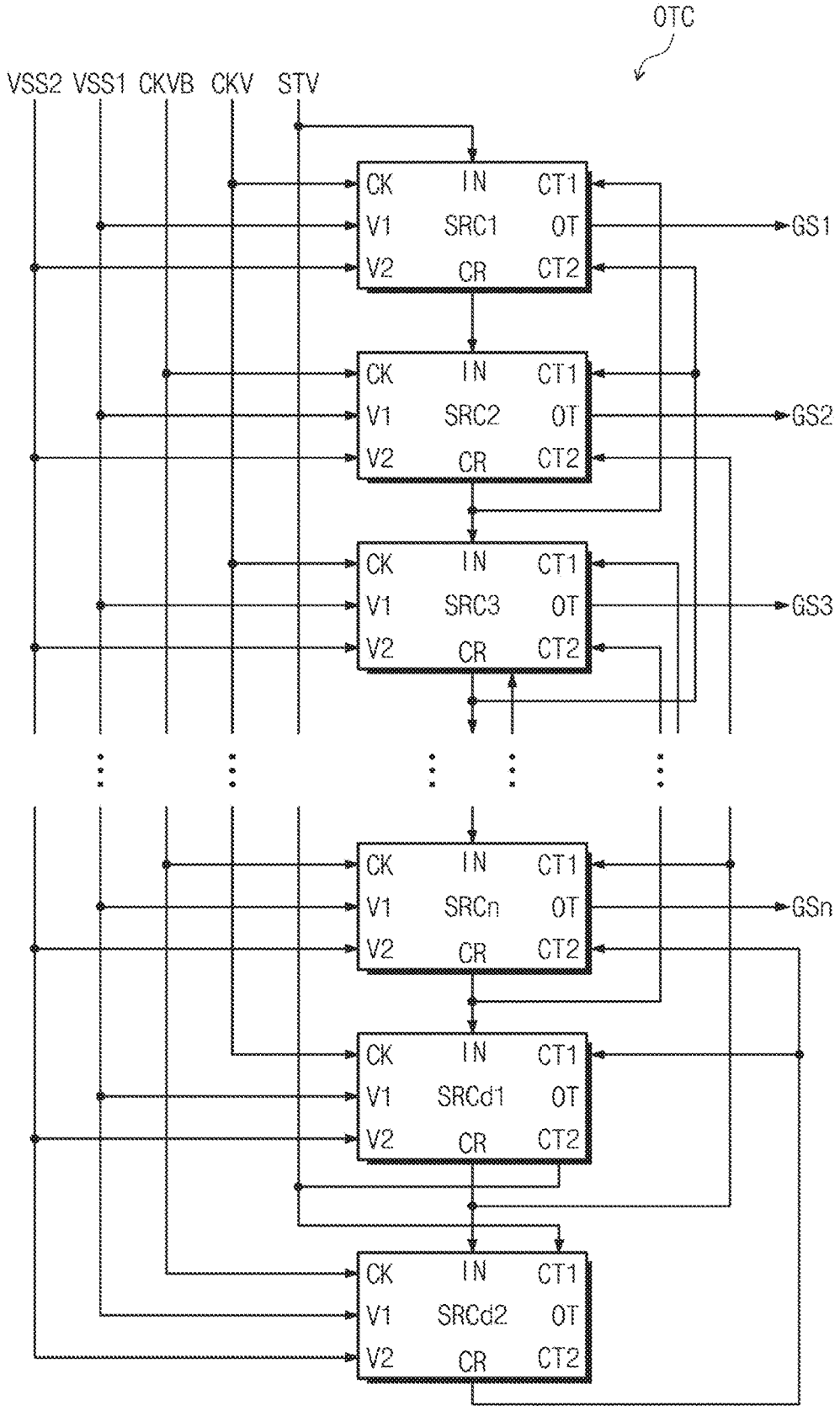
FIG. 5A is a block diagram showing a plurality of shift registers included in the output circuit shown in FIG. 4.
Figure 5B:
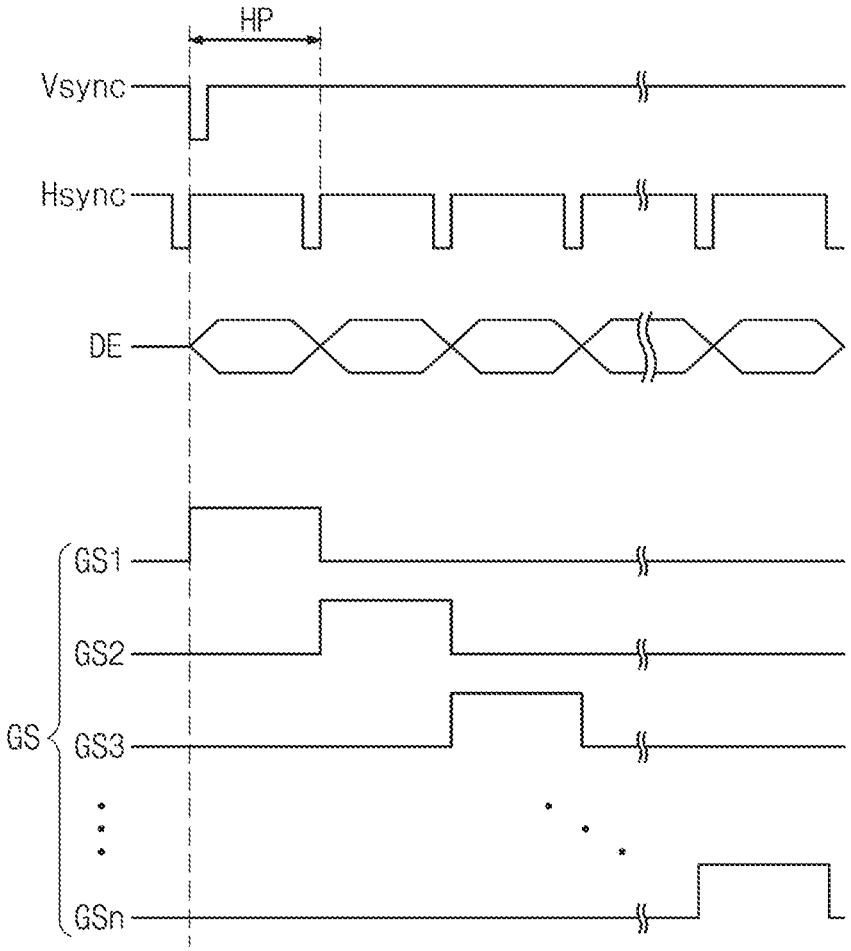
FIG. 5B is a timing diagram showing gate signals according to an exemplary embodiment.

FIG. 4 is a block diagram showing an output circuit and a detection circuit, which are included in the gate driving circuit shown in FIG. 2. FIG. 5A is a block diagram showing a plurality of shift registers included in the output circuit shown in FIG. 4, and FIG. 5B is a timing diagram showing gate signals according to an exemplary embodiment.

Referring to FIG. 4, the gate driving circuit 200 may include an output circuit OTC and the detection circuit DTC. The output circuit OTC sequentially outputs gate signals GS1 to GSn to the pixels PX11 to PXnm (refer to FIG. 2).

Referring to FIG. 5A, the output circuit OTC includes a plurality of stages SRC1 to SRCn. The stages SRC1 to SRCn form one shift register. As shown in FIG. 5A, the stages SRC1 to SRCn are connected to each other one after another.

The stages SRC1 to SRCn are respectively connected to the gate lines GL1 to GLn. That is, the stages SRC1 to SRCn apply the gate signals to the gate lines GL1 to GLn.

Each of the stages SRC1 to SRCn includes an input terminal IN, a clock terminal CK, a first voltage input terminal V1, a second voltage input terminal V2, a first control terminal CT1, a second control terminal CT2, an output terminal OT, and a carry terminal CR.

The carry terminal CR of each of the stages SRC1 to SRCn is electrically connected to the input terminal IN of a next stage. The input terminal IN of a first stage SRC1 receives the vertical start signal STV starting a drive of the gate driving circuit 200 instead of a carry signal of a previous stage. The input terminal IN of each of the stages SRC2 to SRCn except for the first stage SRC1 receives the carry signal of the previous stage. For instance, an input terminal IN of an i-th stage is electrically connected to a carry terminal CR of an (i−1)th stage. Here, "i" is an integer number greater than 1 and smaller than "n". Input terminals IN of second and third stages SRC2 and SRC3 respectively receive carry signals of the first and second stages SRC1 and SRC2.

Meanwhile, according to other exemplary embodiments, the input terminal IN of the i-th stage may be electrically connected to one of carry terminals of previous stages, e.g., a carry terminal of (i−1)th, (i−2)th, or (i−3)th stage. As an example, the second stage SRC2 may receive a start signal different from a start signal applied to the first stage SRC1, and the input terminal IN of the third stage SRC3 may receive the carry signal of the first stage SRC1.

The first control terminal CT1 of each of the stages SRC1 to SRCn is electrically connected to the carry terminal CR of the next stage to receive the carry signal of the next stage. The second control terminal CT2 of each of the stages SRC1 to SRCn is electrically connected to a carry terminal CR of a stage connected to the next stage.

The first control terminal CT1 of the i-th stage is electrically connected to the carry terminal CR of the (i+1)th stage, and the second terminal CT2 of the i-th stage is electrically connected to the carry terminal CR of the (i+2)th stage. The first control terminal CT1 of the first stage SRC1 is electrically connected to the carry terminal CR of the second stage SRC2, and the second terminal CT2 of the first stage SRC1 is electrically connected to the carry terminal CR of the third stage SRC3.

However, first and second control terminals CT1 and CT2 of the last stage SRCn among the stages SRC1 to SRCn receive signals corresponding to the carry signal from dummy stages SRCd1 and SRCd2. The dummy stages SRCd1 and SRCd2 are sequentially connected to a rear end of the last stage SRCn. The positions and number of the dummy stages SRCd1 and SRCd2 may be changed according to the design intent of those skilled in the art.

Meanwhile, according to other exemplary embodiments, it is sufficient that the first control terminal CT1 of the i-th stage is electrically connected to the carry terminal CR of the stages after the i-th stage. In addition, it is sufficient that the second control terminal CT2 of the i-th stage is electrically connected to the carry terminal CR of the stages after the stage that applies the carry signal to the first control terminal CT1 of the i-th stage.

FIG. 5A shows an example of the gate driving circuit, and thus a connection relation between the stages SRC1 to SRCn shown in FIG. 5A may be changed.

Among the stages SRC1 to SRCn, odd-numbered stages SRC1 and SRC3 receive signals having opposite phase to that of even-numbered stages SRC2 and SRC4. The clock terminal CK of the odd-numbered stages SRC1 and SRC3 receive a clock signal CKV, and the clock terminal CK of the even-numbered stages SRC2 and SRC4 receive a clock bar signal CKVB.

The clock signal CKV and the clock bar signal CKVB have a phase difference of about 180 degrees. Each of the clock signal CKV and the clock bar signal CKVB swings between a first clock voltage and a second clock voltage. The first clock voltage may be within a range of about 15 volts to about 35 volts. The second clock voltage may be within a range of about −16 volts to about −10 volts.

A first low voltage VSS1 is applied to the first voltage input terminal V1 of each of the stages SRC1 to SRCn, and a second low voltage VSS2 having a voltage level higher than that of the first low voltage VSS1 is applied to the second voltage input terminal V2 of each of the stages SRC1 to SRCn. The second low voltage VSS2 may be within a range of about −10 volts to about −5 volts, and the first low voltage VSS1 may be within a range of about −16 volts to about −10 volts. As an example, the first low voltage VSS1 may be about −11.5 volts, and the second low voltage VSS2 may be about −7.5 volts. The first low voltage VSS1 may have the same level as the second clock voltage.

The output terminal OT of each of the stages SRC1 to SRCn is connected to a corresponding gate line. That is, the output terminals OT of the stages SRC1 to SRCn sequentially output first to n-th gate signals GS1 to GSn to the gate lines GL1 to GLn.

Referring to FIG. 5B, the signal controller 100 may output a signal required to distinguish horizontal periods HP, i.e., a horizontal synchronization signal Hsync as a row distinction signal, and a data enable signal maintained at a high level during a period, in which data are output, to indicate a data input period, to the data driving circuit 300. The horizontal synchronization signal Hsync and the data enable signal may be included in the control signal CTS.

The data voltages DE output from the data driving circuit 300 may include positive data voltages having a positive value with respect to a common voltage and/or negative data voltages having a negative value with respect to the common voltage. Among the data voltages DE applied to the data lines DL1 to DLm during each of the horizontal periods HP, some data voltages have the positive polarity, and the other data voltages have the negative polarity. The polarity of the data voltages DE may be inverted every one or more unit frame periods to prevent liquid crystals from burning or deteriorating. The data driving circuit 300 may generate the data voltages DE inverted in a frame period unit in response to the inversion signal.

The output circuit OTC included in the gate driving circuit 200 respectively outputs the gate signals GS1 to GSn to the gate lines GL1 to GLn during the unit frame period in response to the gate control signal G-CS provided from the signal controller 100. The gate signals GS1 to GSn may be sequentially output corresponding to the horizontal periods HP. That is, the active period of each of the gate signals GS1 to GSn may correspond to one horizontal period HP. Here, the active period of the gate signal means a period in which the gate signal has the high voltage level.

Figure 6A:
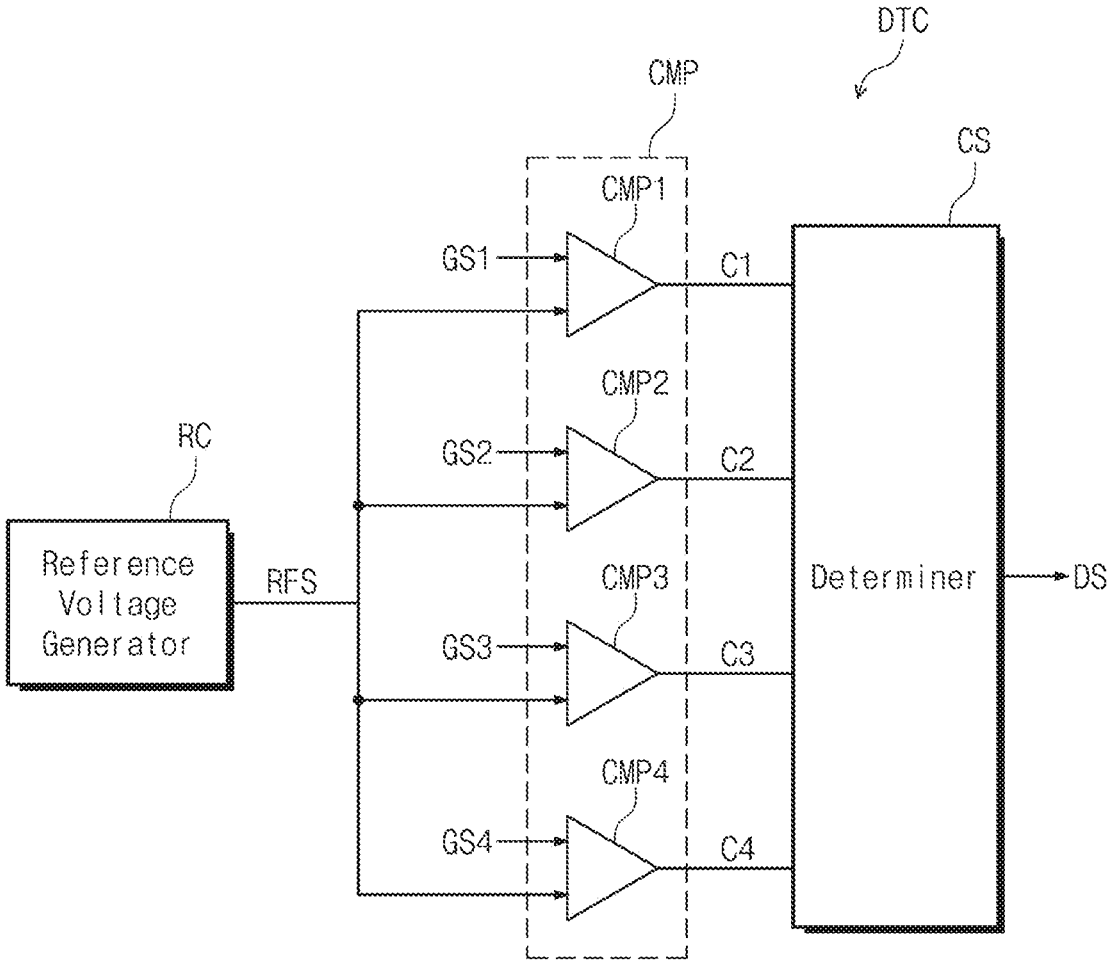
FIG. 6A is a block diagram showing the detection circuit shown in FIG. 4 according to an exemplary embodiment.
Figure 6B:
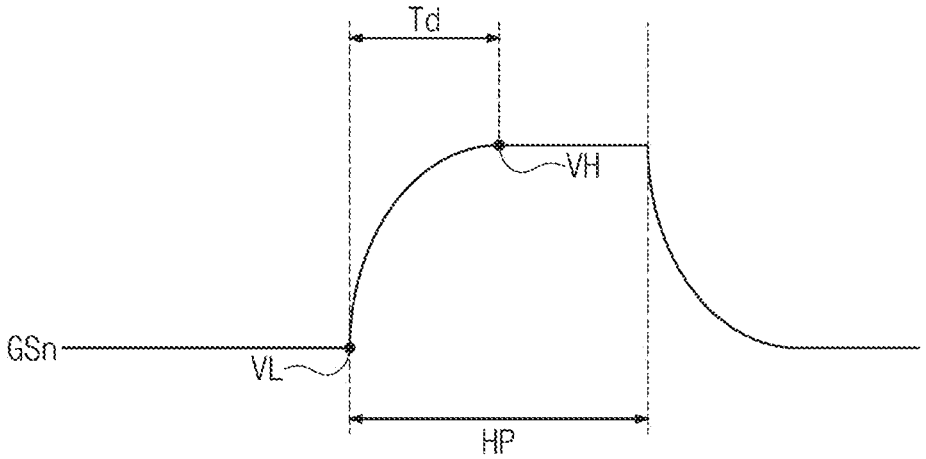
FIG. 6B is a timing diagram showing an output of a gate signal according to an exemplary embodiment.
Figure 6D:
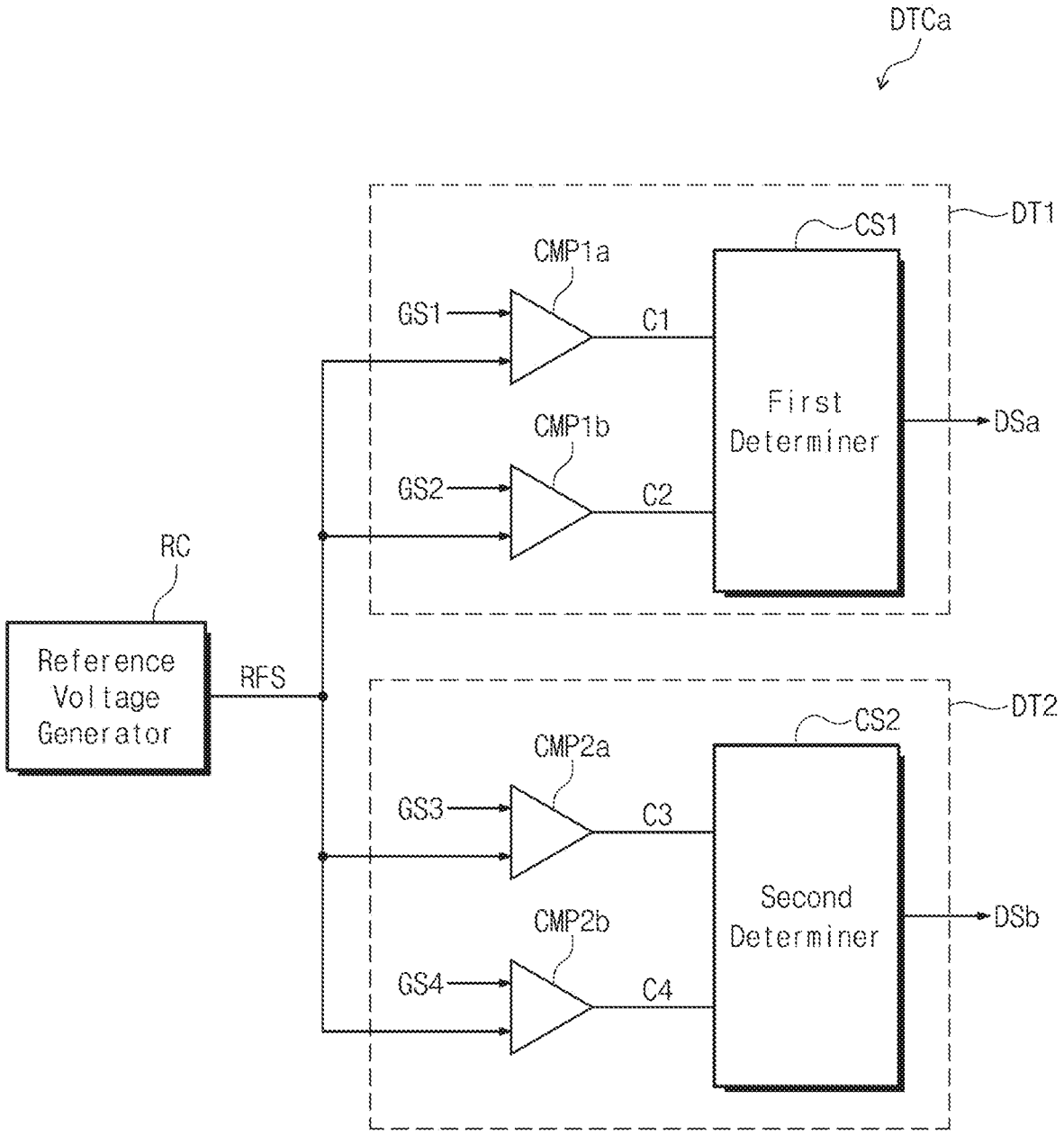
FIG. 6D is a block diagram showing a detection circuit according to another exemplary embodiment.

FIG. 6A is a block diagram showing the detection circuit DTC shown in FIG. 4 according to an exemplary embodiment. FIG. 6B is a timing diagram showing an output of a gate signal according to an exemplary embodiment. FIG. 6C is a table showing information about distortion of a gate signal based on an operation of the detection circuit DTC shown in FIG. 6A. FIG. 6D is a block diagram showing a detection circuit DTCa according to another exemplary embodiment.

Referring to FIG. 6A, the detection circuit DTC according to the exemplary embodiment includes a reference voltage generator RC, a comparator unit CMP, and a determiner CS.

The detection circuit DTC shown in FIG. 6A determines whether the signal distortion occurs in first to fourth gate signals among the gate signals GS1 to GSn shown in FIG. 5A, but it should not be limited thereto or thereby. That is, the detection circuit DTC may determine whether the signal distortion occurs with respect to at least two or more gate signals among the gate signals GS1 to GSn or with respect to all the gate signals GS1 to GSn.

The reference voltage generator RC generates a reference voltage RFS and applies the reference voltage RFS to the comparator unit CMP. The reference voltage generator RC applies the reference voltage RFS to each of comparators CMP1 to CMP4 included in the comparator unit CMP. In addition, the reference voltage generator RC may receive a voltage corresponding to the reference voltage RFS from a power circuit (not shown) that generates the low voltages VSS1 and VSS2 shown in FIG. 5A.

The comparator unit CMP includes the first to fourth comparators CMP1 to CMP4 each of which compares the reference voltage RFS with a corresponding gate signal among the gate signals GS1 to GS4.

The first comparator CMP1 receives the reference voltage RFS and the first gate signal GS1. The first comparator CMP1 compares the reference voltage RFS with a first high voltage of the first gate signal GS1. The first comparator CMP1 outputs a voltage difference (hereinafter, referred to as a "first voltage difference) between the reference voltage RFS and the first high voltage to the determiner CS as a first comparison signal C1.

The second comparator CMP2 receives the reference voltage RFS and the second gate signal GS2. The second comparator CMP2 compares the reference voltage RFS with a second high voltage of the second gate signal GS2. The second comparator CMP2 outputs a voltage difference (hereinafter, referred to as a "second voltage difference)

between the reference voltage RFS and the second high voltage to the determiner CS as a second comparison signal C2.

The third comparator CMP3 receives the reference voltage RFS and the third gate signal GS3. The third comparator CMP3 compares the reference voltage RFS with a third high voltage of the third gate signal GS3. The third comparator CMP3 outputs a voltage difference (hereinafter, referred to as a "third voltage difference) between the reference voltage RFS and the third high voltage to the determiner CS as a third comparison signal C3.

The fourth comparator CMP4 receives the reference voltage RFS and the fourth gate signal GS4. The fourth comparator CMP4 compares the reference voltage RFS with a fourth high voltage of the fourth gate signal GS4. The fourth comparator CMP4 outputs a voltage difference (hereinafter, referred to as a "fourth voltage difference) between the reference voltage RFS and the fourth high voltage to the determiner CS as a fourth comparison signal C4.

The determiner CS compares the first to fourth comparison signals C1 to C4 with each other and determines whether the first to fourth gate signals GS1 to GS4 are normal based on the compared result. The determiner CS applies a determination signal DS based on the compared result to the signal controller 100.

Referring to FIG. 6B, each of the first to fourth gate signals according to the exemplary embodiment may have the high voltage after a predetermine time Td elapses from a time point at which the active period HP of the gate signal starts. Here, a voltage level of the gate signal at the time point at which the active period HP starts may be a low voltage VL. In addition, the high voltage of each of the first to fourth gate signals may have a maximum voltage level VH in the active period HP.

As an example, the first gate signal GS1 may have the first high voltage with the maximum voltage level VH after the predetermine time Td elapses from the time point at which the active period HP starts. The second gate signal GS2 may have the second high voltage with the maximum voltage level VH after the predetermine time Td elapses from the time point at which the active period HP starts. In a case that the first gate signal GS1 and the second gate signal GS2 are the normal signal, the first high voltage and the second high voltage may be the same as each other.

Referring to FIG. 6C, the determiner CS compares the first to fourth comparison signals C1 to C4 with each other and determines whether the first to fourth gate signals GS1 to GS4 are normal based on the compared result.

According to the present exemplary embodiment, in a case that is shown in the first line of the table, the first to fourth voltage differences are the same as each other, i.e., the first to fourth voltage differences have a first level VLt, the determiner CS determines that the first to fourth gate signals GS1 to GS4 are the normal signal. The determiner CS applies a determination signal DS_T having information of the normal signal to the signal controller 100.

According to the present exemplary embodiment, in a case that the first to fourth voltage differences are different from each other, the determiner CS determines that at least one gate signal of the first to fourth gate signals GS1 to GS4 is the distortion signal.

In the present exemplary embodiment, it is assumed that the first gate signal GS1 is the distortion signal as a representative example. In this case that is shown in the second line of the table, the second to fourth voltage differences have the first level VLt, and the first voltage difference has a second level VLf. As a result, the determiner CS applies a determination signal DS_F having information of the distortion signal to the signal controller 100 since one gate signal among the first to fourth gate signals GS1 to GS4 is the distortion signal.

As an example, it is assumed that the third gate signal GS3 is the distortion signal. In this case that is shown in the third line of the table, the first, second, and fourth voltage differences have the first level VLt, and the third voltage difference has the second level VLf. As a result, the determiner CS applies the determination signal DS_F having information of the distortion signal to the signal controller 100 since one gate signal among the first to fourth gate signals GS1 to GS4 is the distortion signal.

Meanwhile, the signal controller 100 may detect which gate signal among the first to fourth gate signals GS1 to GS4 is the distortion signal based on the determination signal DS_F having the information of the distortion signal.

The detection circuit DTCa shown in FIG. 6D may include a plurality of detection units when compared with the detection circuit DTC shown in FIG. 6A. A reference voltage generator RC included in the detection circuit DTCa shown in FIG. 6D may be the same as the reference voltage generator RC shown in FIG. 6A.

According to the present exemplary embodiment, the gate signals are classified into at least two groups, and the detection circuit DTCa includes the detection units each of which detects gate signals of a corresponding group of the two groups.

As an example, the first and second gate signals GS1 and GS2 are classified into a first group, and the third and fourth gate signals GS3 and GS4 are classified into a second group.

The detection circuit DTCa includes a first detection unit DT1 and a second detection unit DT2. The first detection unit DT1 includes a first comparator CMP1*a*, a second comparator CMP1*b*, and a first determiner CS1. The first detection unit DT1 may determine whether the first and second gate signals GS1 and GS2 are the normal signals. An operation of the first detection unit DT1 is substantially the same as that of the comparator unit CMP and the determiner CS described with reference to FIG. 6A, and thus details thereof will be omitted.

The second detection unit DT2 includes a third comparator CMP2*a*, a fourth comparator CMP2*b*, and a second determiner CS2. The second detection unit DT2 may determine whether the third and fourth gate signals GS3 and GS4 are the normal signals. Similarly, an operation of the second detection unit DT2 is substantially the same as that of the comparator unit CMP and the determiner CS described with reference to FIG. 6A, and thus details thereof will be omitted.

As described above, the detection circuit DTCa shown in FIG. 6D includes the plural detection units, and thus the detection circuit DTCa may easily check which gate signal among the gate signals is the distortion signal.

Figure 7A:
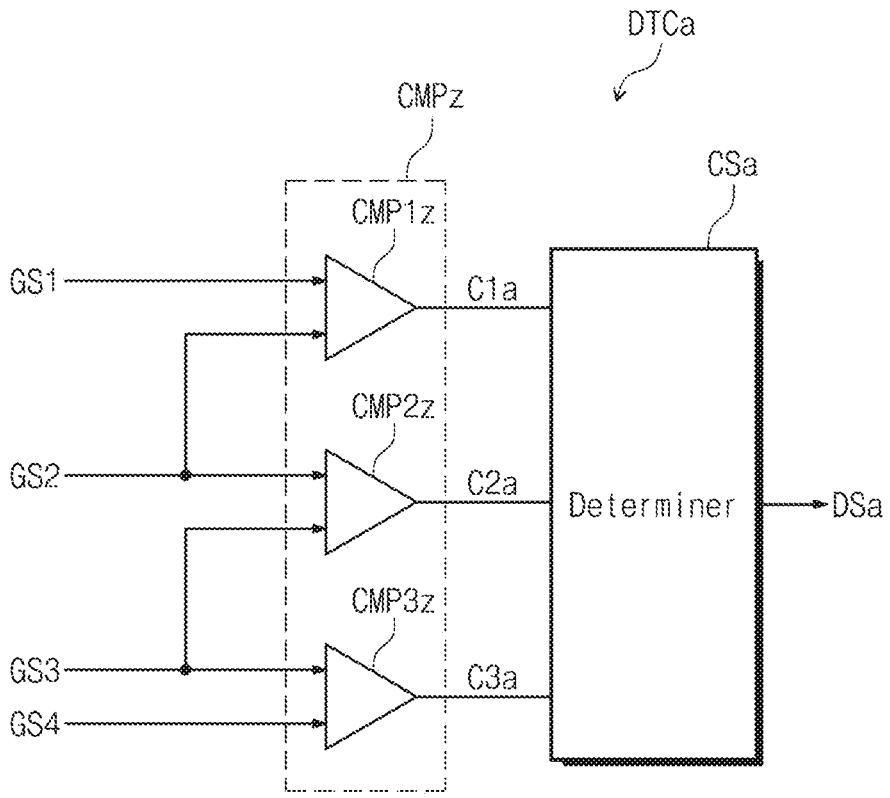
FIG. 7A is a block diagram showing a detection circuit according to another exemplary embodiment.
Figure 7B:
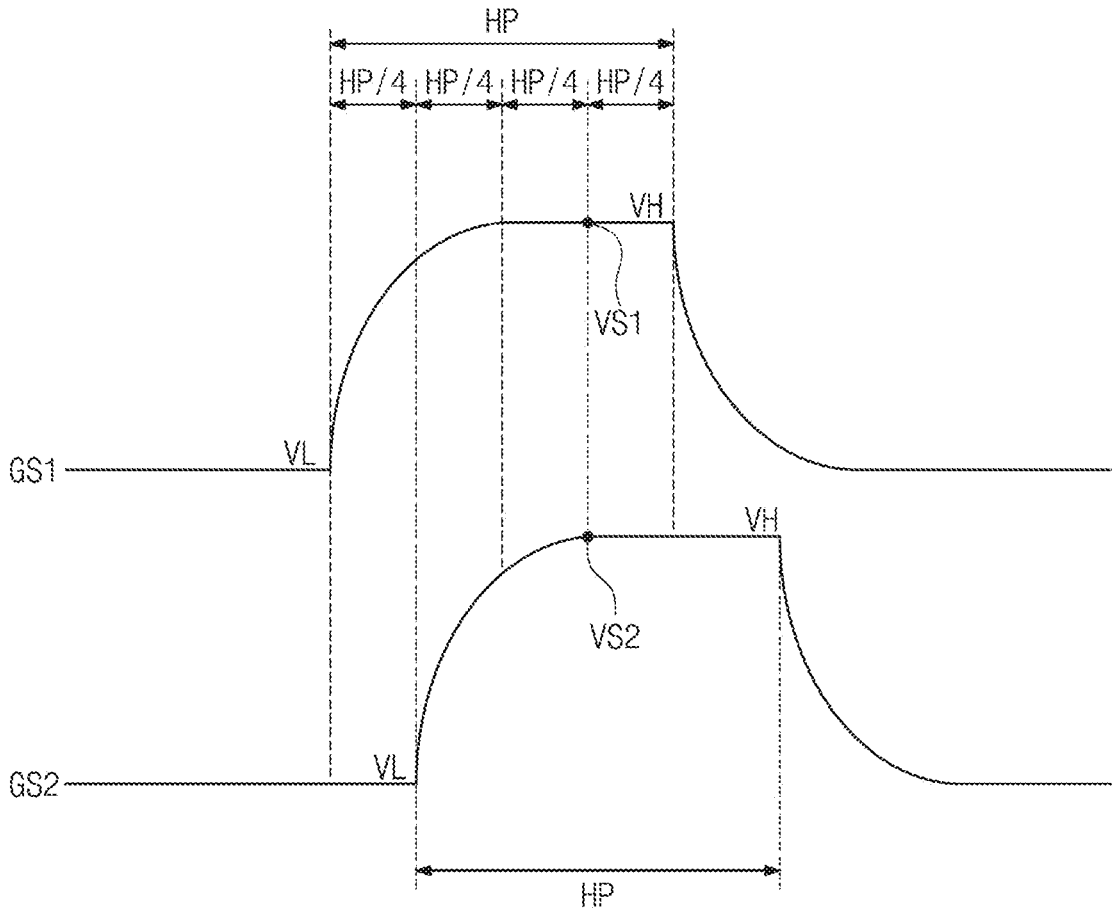
FIG. 7B is a timing diagram showing an output of a gate signal according to another exemplary embodiment.

FIG. 7A is a block diagram showing a detection circuit DTCa according to another exemplary embodiment. FIG. 7B is a timing diagram showing an output of a gate signal according to another exemplary embodiment. FIG. 7C is a table showing information about distortion of a gate signal based on an operation of the detection circuit shown in FIG. 7A.

Referring to FIG. 7A, the detection circuit DTCa includes a comparator unit CMPz and a determiner CSa. The detection circuit DTCa shown in FIG. 7A may have the same configuration as that of the detection circuit DTC shown in FIG. 6A except for the reference voltage generator RC, which is omitted in FIG. 7A.

According to the present exemplary embodiment, the detection circuit DTCa may determine whether the gate signals are the normal signals based on the voltage difference between the gate signals. Hereinafter, for the convenience of explanation, an exemplary embodiment that determines whether the first to fourth gate signals GS1 to GS4 are the normal signals will be described. In addition, three comparators are used to determine whether the first to fourth gate signals GS1 to GS4 are the normal signals, but they should not be limited thereto or thereby. That is, the number of the comparators may be determined to correspond to the number of the gate signals. As an example, the number of the comparators may be set to be smaller than the number of the gate signals.

The comparator unit CMPz includes first, second, and third comparators CMP1z, CMP2z, and CMP3z. The first comparator CMP1z receives a first gate signal GS1 and a second gate signal GS2. The first comparator CMP1z compares a voltage level of a first high voltage of the first gate signal GS1 with a voltage level of a second high voltage of the second gate signal GS2. The first comparator CMP1z outputs a first voltage difference between the first high voltage and the second high voltage to the determiner CSa as a first comparison signal C1*a*.

The second comparator CMP2z receives the second gate signal GS2 and a third gate signal GS3. The second comparator CMP2z compares the voltage level of the second high voltage of the second gate signal GS2 with a voltage level of a third high voltage of the third gate signal GS3. The second comparator CMP2z outputs a second voltage difference between the second high voltage and the third high voltage to the determiner CSa as a second comparison signal C2*a*.

The third comparator CMP3z receives the third gate signal GS3 and a fourth gate signal GS4. The third comparator CMP3z compares the voltage level of the third high voltage of the third gate signal GS3 with a voltage level of a fourth high voltage of the fourth gate signal GS4. The third comparator CMP3z outputs a third voltage difference between the third high voltage and the fourth high voltage to the determiner CSa as a third comparison signal C3*a*.

The determiner CSa compares the first to third comparison signals C1*a* to C3*a* with each other and determines whether the first to fourth gate signals GS1 to GS4 are the normal signals based on the compared results. The determiner CSa applies a determination signal DSa to the signal controller 100 based on the determined result.

Referring to FIG. 7B, the gate driving circuit 200 (refer to FIG. 2) may output the first and second gate signals GS1 and GS2 such that an active period HP of the first gate signal GS1 overlaps with a active period HP of the second gate signal GS2. That is, the gate driving circuit 200 may sequentially output the gate signals GS1 to GSn such that active periods of two gate signals adjacent to each other among the gate signals GS1 to GSn overlap with each other.

In detail, the gate driving circuit 200 may output the second gate signal GS2 before the first gate signal GS1 is changed to a non-active period from the active period HP. Here, the changing of the first gate signal GS1 to the non-active period from the active period HP means that the first gate signal GS1 is transited to the low voltage VL from the high voltage VH.

Meanwhile, as shown in FIG. 7B, the active period HP may be divided into four sub-periods HP/4. According to the present exemplary embodiment, the second gate signal GS2 may be transited to the high voltage VH from the low voltage VL later than a time point at which the first gate signal GS1 is transited to the high voltage VH from the low voltage VL by one sub-period HP/4. That is, the gate driving circuit 200 may sequentially output the gate signals GS1 to GSn in the unit of one sub-period HP/4.

As an example, the first comparator CMP1z may compare a first maximum voltage level VS1 of the first gate signal GS1 with a second maximum voltage level VS2 of the second gate signal GS2. The first and second maximum voltage levels VS1 and VS2 may be the high voltage VH. In this case, the first comparator CMP1z may compare the first and second maximum voltage levels VS1 and VS2 with each other in the period in which the active period of the first gate signal GS1 overlaps with the active period of the second gate signal GS2.

In addition, according to FIG. 7B, the first voltage difference may be a difference between a voltage level of the first gate voltage GS1 after a predetermined time elapses from a time point at which the first gate signal GS1 is transited to the high voltage VH from the low voltage VL and a voltage level of the second gate voltage GS2 after the predetermined time elapses from a time point at which the second gate signal GS2 is transited to the high voltage VH from the low voltage VL.

Referring to FIG. 7C, the determiner CSa compares the first to third comparison signals C1*a* to C3*a* with each other and determines whether the first to fourth gate signals GS1 to GS4 are the normal signals based on the compared result.

According to the present exemplary embodiment, in a case that is shown in the first line of the table, the first to third voltage differences are the same as each other, i.e., the first to third voltage differences have the first level VLt, the determiner CSa determines that the first to fourth gate signals GS1 to GS4 are the normal signals. The determiner CSa applies a determination signal DS_T having information of the normal signal to the signal controller 100.

According to the present exemplary embodiment, in a case that the first to third voltage differences are different from each other, the determiner CSa determines that at least one gate signal of the first to fourth gate signals GS1 to GS4 is the distortion signal.

As an example, in a case that is shown in the second line of the table, the first and third voltage differences have the first level VLt and the second voltage difference has the second level VLf different from the first level VLt, the determiner CS determines that one gate signal among the first to fourth gate signals GS1 to GS4 is distorted. Accordingly, the determiner CS applies a determination signal DS_F having information of the distortion signal to the signal controller 100.

As an example, in a case that is shown in the third line of the table, the second and third voltage differences have the first level VLt and the first voltage difference has the second level VLf different from the first level VLt, the determiner CS determines that one gate signal among the first to fourth gate signals GS1 to GS4 is distorted. Accordingly, the determiner CS applies the determination signal DS_F having information of the distortion signal to the signal controller 100.

That is, the determiner CS determines that the gate signals GS1 to GSn output is from the gate driving circuit 200 are normal only when the first to third voltage differences are the same as each other.

Figure 8:
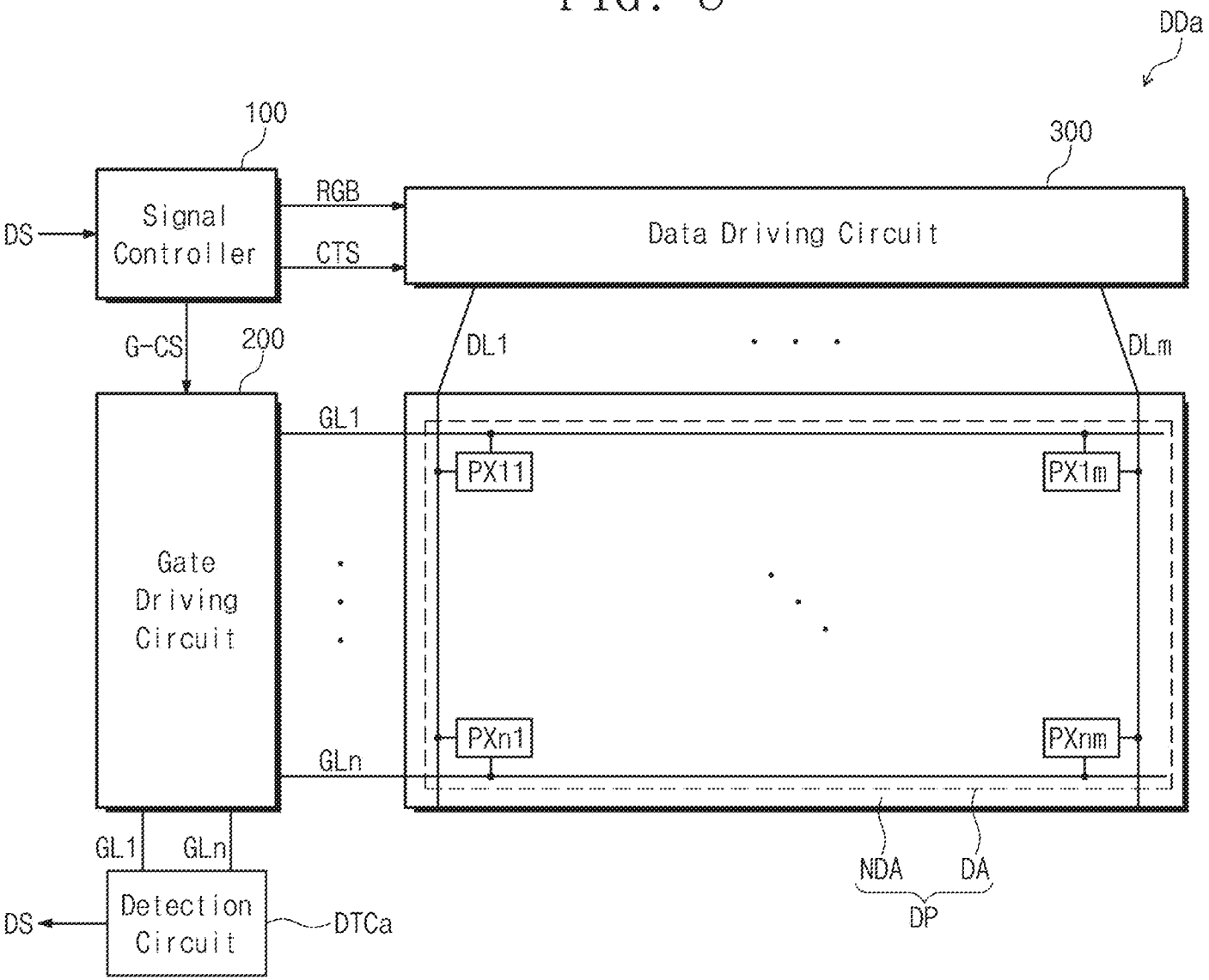
FIG. 8 is a block diagram showing a display device according to another exemplary embodiment.

FIG. 8 is a block diagram showing a display device DDa according to another exemplary embodiment. The display device DDa shown in FIG. 8 has the same configuration and function as those of the display device DD shown in FIG. 2 except for a detection circuit DTCa provided as a separate element without being included in the gate driving circuit 200. Therefore, details of the display device DDa shown in FIG. 8 will be omitted.

Figure 9:
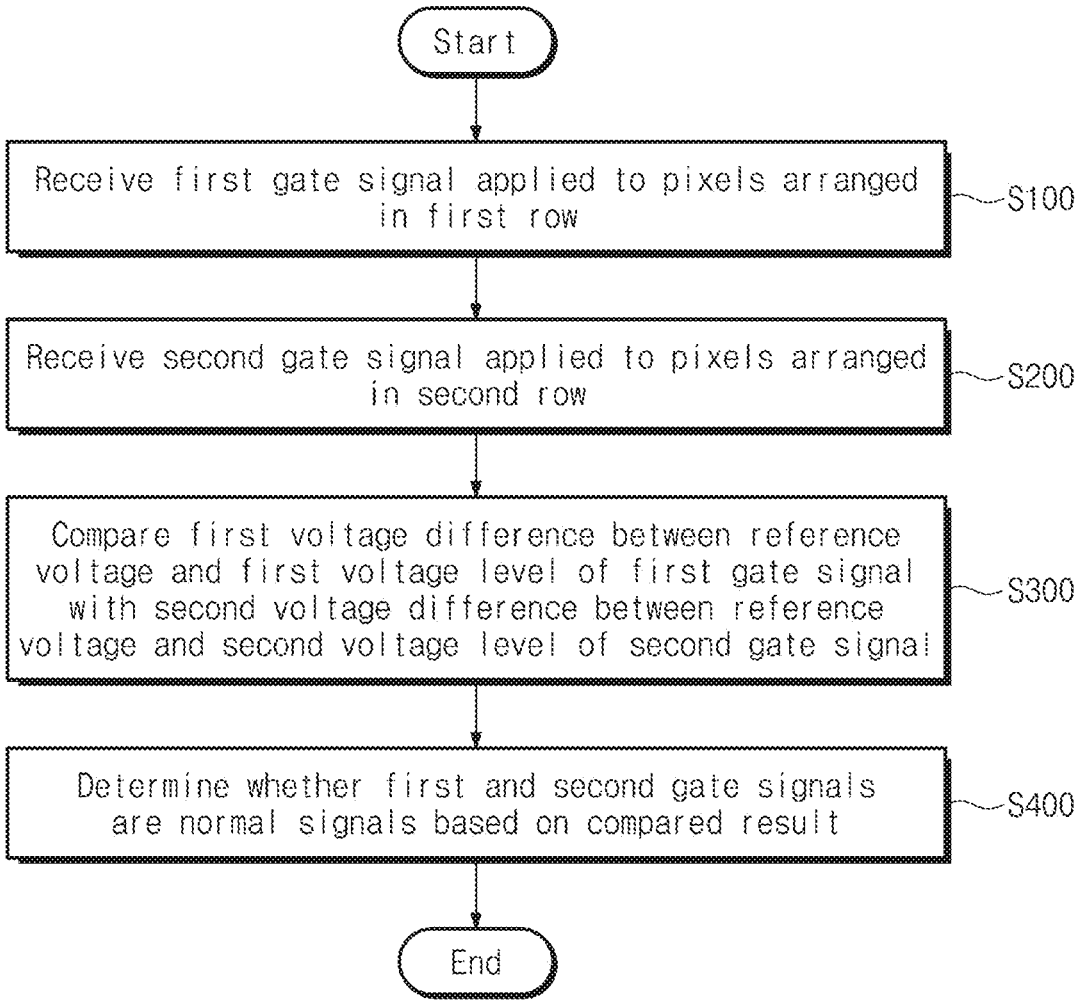
FIG. 9 is a flowchart showing a method of driving a display device according to an exemplary embodiment.

FIG. 9 is a flowchart showing a method of driving a display device according to an exemplary embodiment. Hereinafter, an overall operation of the detection circuit according to the exemplary embodiment will be described in detail with reference to FIGS. 2 and 9.

In detail, in first and second operations S100 and S200, the detection circuit DTC receives the first gate signal GS1 applied to pixels arranged in a first row among the pixels and a second gate signal GS2 applied to pixels arranged in a second row among the pixels.

In third operation S300, the detection circuit DTC compares the first voltage difference between the reference voltage and the first voltage level of the first gate signal GS1 with the second voltage difference between the reference voltage and the second voltage level of the second gate signal GS2. Here, the first voltage level may be the high voltage level of the first gate signal GS1, and the second voltage level may be the high voltage level of the second gate signal GS2.

In fourth operation S400, the detection circuit DTC may determine whether the first and second gate signals GS1 and GS2 are the normal signals based on the compared result of the first and second voltage differences. The operation of the detection circuit DTC, which determines whether the first and second gate signals GS1 and GS2 are the normal signals, may be performed based on the above-mentioned exemplary embodiments.

In addition, as an example, the reference voltage may be output from a power unit (not shown) that generates powers required to drive the display device. In this case, the detection circuit DTC shown in FIG. 6A may carry out the first to fourth operations S100 to S400.

As another example, the reference voltage may be the voltage level of the third gate signal GS3. In this case, the detection circuit DTCa shown in FIG. 7A may carry out the first to fourth operations S100 to S400.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. A display device, comprising:

a display panel comprising a plurality of pixels;

a gate driving circuit outputting a plurality of gate signals to the plurality of pixels; and a detection circuit receiving a first gate signal and a second gate signal among the plurality of gate signals, comparing a first voltage difference between a first high voltage of the first gate signal and a reference voltage with a second voltage difference between a second high voltage of the second gate signal and the reference voltage to achieve a compared result, and determining whether the first and second gate signals are normal signals based on the compared result.

2. The display device of claim 1, wherein the first high voltage is a voltage level after a first predetermined time elapses from a time point at which an active period of the first gate signal starts, and the second high voltage is a voltage level after a second predetermined time elapses from a time point at which an active period of the second gate signal starts.

3. The display device of claim 1, wherein the first high voltage has a maximum voltage level of the first gate signal, and the second high voltage has a maximum voltage level of the second gate signal.

4. The display device of claim 1, wherein the detection circuit comprises:

a comparator unit outputting a first comparison signal corresponding to the first voltage difference and a second comparison signal corresponding to the second voltage difference; and a determiner receiving the first comparison signal and the second comparison signal to determine whether the first and second gate signals are the normal signals.

5. The display device of claim 4, wherein the comparator unit comprises:

a first comparator outputting the first comparison signal; and a second comparator outputting the second comparison signal.

6. The display device of claim 5, wherein the detection circuit further comprises a reference voltage generator that outputs the reference voltage, and the reference voltage generator outputting the reference voltage to each of the first comparator and the second comparator.

7. The display device of claim 1, wherein the detection circuit comprises a first detection unit and a second detection unit, the first detection unit receiving the first gate signal and the second gate signal to determine whether the first and second gate signals are the normal signals, and the second detection unit receiving a third gate signal and a fourth gate signal among the plurality of gate signals to determine whether the third and fourth gate signals are the normal signals.

8. The display device of claim 7, wherein the second detection unit compares a third voltage difference between a third high voltage of the third gate signal and the reference voltage with a fourth voltage difference between a fourth high voltage of the fourth gate signal and the reference voltage, to determine whether the third and fourth gate signals are the normal signals based on the compared result.

9. The display device of claim 1, wherein the detection circuit determines that the first gate signal and the second gate signal are the normal signals when the first voltage difference is equal to the second voltage difference.

10. The display device of claim 9, wherein the detection circuit determines that one of the first gate signal and the second gate signal is a distortion signal when the first voltage difference is different from the second voltage difference.

11. The display device of claim 2, wherein the first predetermined time and the second predetermined time are the same.

12. The display device of claim 1, wherein the detection circuit is built into the gate driving circuit.

13. A display device, comprising:

a gate driving circuit sequentially outputting a plurality of gate signals;

a display panel comprising a plurality of pixels driven in response to active periods of the plurality of gate signals; and a detection circuit receiving first, second, and third gate signals among the plurality of gate signals, comparing a first voltage difference between the first gate signal and the second gate signal with a second voltage difference between the second gate signal and the third gate signal to achieve a compared result, and determining whether the first, second, and third gate signals are normal signals based on the compared result.

14. The display device of claim 13, wherein each of the active periods comprise the same time period, and the gate driving circuit sequentially outputs the plurality of gate signals such that the active periods of at least two gate signals adjacent to each other among the plurality of gate signals overlap with each other.

15. The display device of claim 14, wherein the first voltage difference is a difference between a maximum voltage level of the first gate signal and a maximum voltage level of the second gate signal in a period in which the active periods of the first and second gate signals overlap with each other, and the second voltage difference is a difference between the maximum voltage level of the second gate signal and a maximum voltage level of the third gate signal in a period in which the active periods of the second and third gate signals overlap with each other.

16. The display device of claim 14, wherein the gate driving circuit sequentially outputs the plurality of gate signals at a predetermined time interval shorter than the active period.

17. The display device of claim 13, wherein the first voltage difference is a difference between a voltage level of the first gate signal after a predetermined time elapses from a time point at which the first gate signal is transited to a high voltage from a low voltage and a voltage level of the second gate signal after the predetermined time elapses from a time point at which the second gate signal is transited to the high voltage from the low voltage.

18. The display device of claim 13, wherein the detection circuit comprises:

a first comparator outputting a first comparison signal of the first voltage difference;

a second comparator outputting a second comparison signal of the second voltage difference; and a determiner receiving the first comparison signal and the second comparison signal to determine whether the first, second, and third gate signals are the normal signals based on the compared result.

19. The display device of claim 18, wherein the first comparator receives the first gate signal and the second gate signal, and the second comparator receives the second gate signal and the third gate signal.

20. A method of driving a display device, comprising:

receiving a first gate signal applied to pixels arranged in a first row;

receiving a second gate signal applied to pixels arranged in a second row;

comparing a first voltage difference between a first high voltage of the first gate signal and a reference voltage with a second voltage difference between a second high voltage of the second gate signal and the reference voltage to achieve a compared result; and determining whether the first and second gate signals are normal signals based on the compared result.

* * * * *